US007824097B2

(12) United States Patent
Lippuner et al.

(10) Patent No.: US 7,824,097 B2
(45) Date of Patent: Nov. 2, 2010

(54) MICRO-MECHANICAL PART MADE OF INSULATING MATERIAL AND METHOD OF MANUFACTURING THE SAME

(75) Inventors: Marc Lippuner, Grenchen (CH); Thierry Conus, Lengau (CH); Philippe Marmy, Porrentruy (CH); Benjamin Krähenbühl, Bettlach (CH); Michael Reber, Langenthal (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 0 days.

(21) Appl. No.: 11/691,063

(22) Filed: Mar. 26, 2007

(65) Prior Publication Data

US 2008/0037376 A1 Feb. 14, 2008

(30) Foreign Application Priority Data

Mar. 24, 2006 (EP) ..... 06111727
Apr. 10, 2006 (CH) ..... 0595/06

(51) Int. Cl.
*G04B 17/04* (2006.01)

(52) U.S. Cl. ..... 368/124; 368/168; 368/175

(58) Field of Classification Search ..... 368/168, 368/175, 124
See application file for complete search history.

(56) References Cited

U.S. PATENT DOCUMENTS 5,242,711 A * 9/1993 DeNatale et al. ..... 427/249.9
6,173,612 B1 * 1/2001 Golecki et al. ..... 73/514.29
6,329,066 B1 * 12/2001 Baur et al. ..... 428/472.1
2002/0060954 A1 * 5/2002 Schafroth et al. ..... 368/204
2002/0171150 A1 11/2002 Rudhard
2004/0042349 A1 * 3/2004 Leuba et al. ..... 368/204
2005/0281137 A1 * 12/2005 Bourgeois et al. ..... 368/175

FOREIGN PATENT DOCUMENTS

DE 10127733 A1 * 2/2003
EP 0732635 A1 9/1996
EP 1422436 A1 5/2004
WO 99/36941 7/1999
WO 2004/020329 A1 3/2004
WO 2004/029733 A2 4/2004

OTHER PUBLICATIONS

Translation of Haenni (EP 0732635) :: epo.worldlingo.com/wl/epo/epo.html; Mar. 10, 2009.*
Translation of Holm (DE 10127733) :: epo.worldlingo.com/wl/epo/epo.html; Mar. 12, 2009.*
European Search Report issued in corresponding application No. EP 06 11 1727, completed Jan. 19, 2007.

* cited by examiner

*Primary Examiner*—Renee S Luebke
*Assistant Examiner*—Sean Kayes
(74) *Attorney, Agent, or Firm*—Griffin & Szipl, P.C.

(57) ABSTRACT

A micro-mechanical part made of insulating material, such as a silicon balance spring (1) for a timepiece movement, tends to adhere to a neighboring part when it is in movement, such as the balance cock (9). This drawback is removed by carrying out, over all or part of the surface, a thin deposition of a layer of conductive material, such as a metal, which is preferably non-oxidizing and non-magnetic, such as gold, platinum, rhodium or silicon.

10 Claims, 1 Drawing Sheet

MICRO-MECHANICAL PART MADE OF INSULATING MATERIAL AND METHOD OF MANUFACTURING THE SAME

This application claims priority from European Patent Application No. 06111727.1 filed Mar. 24, 2006 and Swiss Patent Application No. 00595/06 of Apr. 10, 2006.

FIELD OF THE INVENTION

The present invention concerns a micro-mechanical part made of an insulating material, and more specifically a fixed or mobile part of a timepiece movement whose proximity to other parts does not interfere with the working of a mobile part, directly or indirectly by attracting particles.

BACKGROUND OF THE INVENTION

Insulating materials, such as silicon and its compounds, quartz, diamond, glass, ceramic or other materials are used more and more frequently to make micro-mechanical parts for the watch making industry, whether for fixed parts, such as plates or bridges, or for mobile parts forming, for example, part of the kinematic chain, or the regulating system, such as the balance spring, the balance or the escapement.

It has been observed, in particular on a balance spring that is totally isolated from the other parts for example by pinning up to the stud and bonding by means of a non-conductive adhesive, that the use of silicon has one drawback. Indeed, after a certain operating time, a certain number of coils located between the outer terminal curve and the inner terminal curve of the balance spring tend to adhere to the balance cock, which is necessarily detrimental to the isochronism of the regulating system. The same phenomenon can be observed with other parts made of silicon or another insulating material, which will also eventually have a detrimental effect on isochronism.

SUMMARY OF THE INVENTION

It is thus an object of the present invention to provide a solution to the aforementioned problem, by providing a fixed or mobile micro-mechanical part made of an insulating material whose surface treatment avoids the risk of adhesion.

The invention therefore concerns a micro-mechanical part made of an insulating material, such as silicon and its compounds, diamond, glass, ceramic or other materials, all or part of whose surface is coated with a thin deposition of an electrically conductive material such as a metallic material or a non-metallic conductive material. The conductive deposition preferably has a thickness of less than 50 nm. This very thin deposition, invisible to the naked eye, but perceptible via current analysis means, removes the risks of attraction and adhesion by a neighbouring part, this attraction being due to friction or tension liable to create electrostatic charges in the part.

This deposition can be carried out on a monobloc or composite part made of insulating material, i.e. wherein at least the external surface is made of insulating material.

From among materials able to achieve the aforementioned object non-oxidising and non-magnetic metals such as gold, platinum, rhodium and palladium will preferably be chosen.

From among the non-metallic conductive materials, graphite, carbon, doped silicon and conductive polymers will preferably be chosen.

These metals can be deposited by known methods allowing thickness to be controlled by adjusting operating conditions, for example by sputtering, PVD, doping, ionic implantation or by an electrolytic method. The same techniques could be used for depositing non-conductive metallic materials.

In a preferred application mode, said micro-mechanical part is a part in the kinematic chain of a timepiece movement, such as a balance spring, pallets, an escape wheel or a toothed wheel, or any other fixed part able for example to form the arbour bearing of a mobile part. In the following detailed description, the invention will be more particularly illustrated by a balance spring, which is the most sensitive part of a timepiece movement.

The invention also concerns a timepiece integrating a micro-mechanical part of this type.

BRIEF DESCRIPTION OF THE DRAWINGS

Other features and advantages of the present invention will appear more clearly in the following description of an example embodiment, given by way of non-limiting illustration, with reference to the annexed drawings, in which.

DETAILED DESCRIPTION OF THE INVENTION

Figure 1:
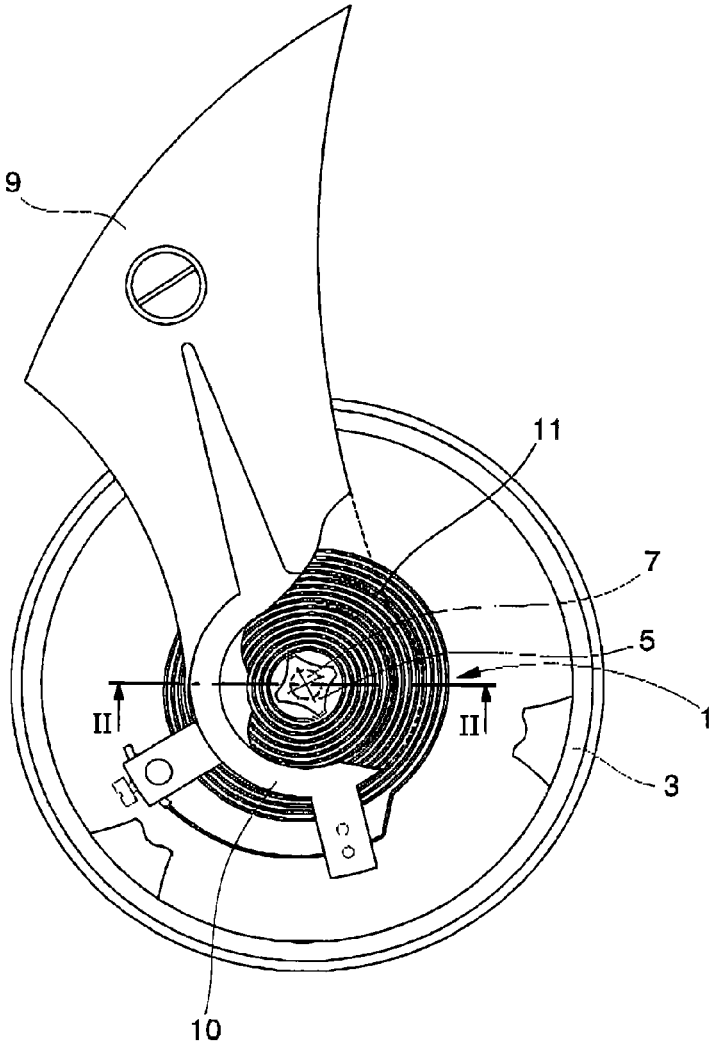
FIG. 1 shows a partially torn away top view of a sprung balance provided with a balance spring treated in accordance with the invention.
Figure 2A:
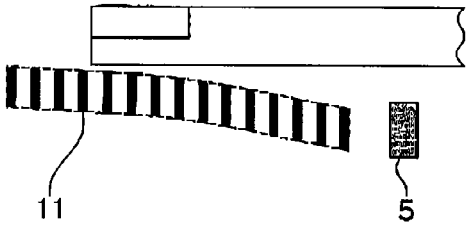
FIG. 2 is a cross-section along the line II-II of FIG. 1, with a diagram of the torn away portion.
Figure 2B:
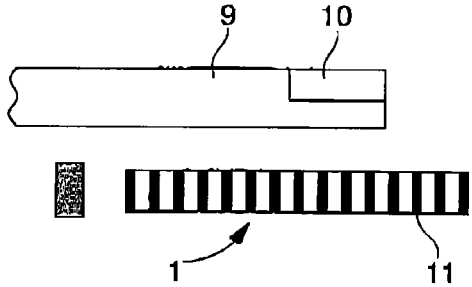

FIG. 1 shows balance spring 1, including a plurality of coils 11; a balance 3; a collet 5; a balance arbour 7; a balance cock 9; and a regulator 10. The invention will be more particularly illustrated by sprung balance regulating device shown in FIG. 1, wherein balance spring 1 is made, by way of example, of silicon, by adapting the micromachining techniques employed in the manufacture of integrated circuits or accelerometers from a plate of silicon or any other amorphous or crystalline insulating material. For example, one could perform wet etching, dry plasma machining or reactive ionic etching (RIE) using masks suitable for the contour desired for the balance spring.

Given the small dimensions, the same silicon plate enables a batch of balance springs to be manufactured, whose features are determined by the thickness of the plate and the shape of the masks, said features being calculated for the balance spring to operate in one plane.

With reference to F*ig*. 2, in which the cross-section is limited to balance spring 1 and balance cock 9, the behaviour of the coils 11 after a certain operating time, when balance spring 1 has not undergone any treatment, is shown in the left part. As can be seen, coils 11 move away from their normal position shown in dotted lines, attached by balance cock 9, and they can even adhere to the latter, which obviously interferes with normal working, i.e. working with only movements of extension/contraction in one plane.

The right part shows balance spring 1 after treatment, the dotted line representing the position that coils 11 would occupy in the absence of treatment. As can be seen, the balance spring remains perfectly within one plane. It has in fact been observed that, surprisingly, by carrying out a treatment consisting of a very thin deposition of electrically conductive material such as a metallic material over all or part of the surface of the coils, the previously described detrimental effect is annihilated, without thereby altering the intrinsic mechanical properties of the balance spring. A "very thin deposition" means a deposition having a thickness of less than 50 nm preferably comprised between 10 and 20 nm. When the deposition is less than 50 nm, the intrinsic mechanical properties of the part are not altered and the deposition is invisible to the naked eye, but nonetheless perceptible via current analysis techniques. The material used is preferably a non-oxidising and non-magnetic metal such as gold, platinum, rhodium, palladium, when a conductive metallic material is used. This deposition can be carried out by means of various known methods, such as sputtering, PVD, ionic implantation or electrolytic deposition.

By way of example, a 15 nm gold deposition was carried out by sputtering, by applying a 60 mA current for 15 seconds.

When a non-metallic conductive material is deposited, it will preferably be selected from among the group comprising graphite, carbon, doped silicon and conductive polymers and the aforementioned deposition techniques and thickness will be used.

We have just described a silicon balance spring, but other amorphous or crystalline non-conductive materials could also be used, such as indicated previously, and treated with a surface metallisation avoiding the risks of attraction and adhesion.

It is also possible to use a composite material to make for example a balance spring with a silicon core and a thick (greater than 50 nm) silicon dioxide coating onto which the thin deposition of conductive material will be made.

A "composite material" can also include a metallic core embedded in an insulating material.

Likewise, the invention is not limited to a balance spring and can be applied to other moving parts, such as pallets, an escape wheel or a toothed wheel, and to other fixed or moving parts of a timepiece movement.

What is claimed is:

1. A silicon balance spring of a time piece movement, comprising:

an insulating material having a surface, wherein the insulating material is silicon or a silicon compound, and wherein all or part of the surface is coated with a deposition of electrically conductive material sufficient to reduce attraction due to electrostatic charges in the part, wherein the electrically conductive material is metal.

2. The silicon balance spring according to claim 1, wherein the metal used for carrying out the deposition is a non-oxidizing and non-magnetic material.

3. The silicon balance spring according to claim 2, wherein the metal is selected from among gold, platinum, rhodium and palladium.

4. The silicon balance spring according to claim 1, wherein the deposition of electrically conductive material has a thickness of less than 50 nm.

5. A portion of a kinematic chain of a time piece movement, comprising:

a micro-mechanical part made of at least one insulating material having a surface, wherein all or part of the surface is coated with a deposition of electrically conductive material sufficient to reduce attraction due to electrostatic charges in the part, and wherein the electrically conductive material is metal, wherein the deposition of conductive material has a thickness of between 10 nm and 20 nm.

6. The portion of the kinematic chain of the time piece movement according to claim 5, wherein the insulating material is selected from among silicon and silicon compounds, diamond, glass and ceramics.

7. The portion of the kinematic chain of the time piece movement according to claim 6, wherein the micro-mechanical part includes a silicon core on which a silicon dioxide coating is formed with a thickness greater than 50 nm.

8. The portion of the kinematic chain of the time piece movement according to claim 5, wherein the metal used for carrying out the deposition is a non-oxidizing and non-magnetic material.

9. The portion of the kinematic chain of the time piece movement according to claim 8, wherein the metal is selected from among gold, platinum, rhodium and palladium.

10. The portion of the kinematic chain of the time piece movement according to claim 6, wherein the micro-mechanical part consists of a component of the escapement or of the sprung balance system selected from among the group consisting of a balance spring, pallets, an escape wheel and a toothed wheel.

* * * * *